US008607380B2

(12) United States Patent
Chang et al.

(10) Patent No.: US 8,607,380 B2
(45) Date of Patent: Dec. 17, 2013

(54) PORTABLE LIGHTWEIGHT BED

(75) Inventors: Leo Yih Lang Chang, Livingston, NJ (US); Phillip Wu, Victoria, TX (US)

(73) Assignee: Inteplast Group, Ltd., Livingston, NJ (US)

( * ) Notice: Subject to any disclaimer, the term of this patent is extended or adjusted under 35 U.S.C. 154(b) by 321 days.

(21) Appl. No.: 13/039,115

(22) Filed: Mar. 2, 2011

(65) Prior Publication Data

US 2012/0222215 A1 Sep. 6, 2012

(51) Int. Cl.
*A47C 17/64* (2006.01)

(52) U.S. Cl.
USPC ..... 5/114; 5/400; 5/701; 5/724; 5/728; 5/656

(58) Field of Classification Search
USPC ..... 5/400, 186.1, 201, 690, 719, 678, 679, 5/701, 739, 924; 108/51.3, 56.1, 56.3, 108/57.19, 57.2, 57.25, 57.29, 57.33
See application file for complete search history.

(56) References Cited

U.S. PATENT DOCUMENTS 3,761,974 A * 10/1973 Kuss ..... 5/679
3,997,102 A 12/1976 Jones
4,019,427 A 4/1977 Down et al.
4,124,158 A 11/1978 Beck
4,171,666 A 10/1979 Swenson et al.
4,230,049 A * 10/1980 Horne ..... 108/57.28
4,251,020 A 2/1981 Schwaner
4,319,370 A 3/1982 Robinson
4,399,972 A * 8/1983 McCulloch ..... 248/346.4
4,467,728 A * 8/1984 Horne ..... 108/57.28
4,868,940 A 9/1989 Masadi
4,945,007 A 7/1990 Coalier et al.
4,970,743 A * 11/1990 Wride et al. ..... 5/679
5,008,141 A 4/1991 Shinozuka
5,020,175 A 6/1991 Kirkpatrick et al.
5,099,529 A 3/1992 Anderson
5,115,524 A 5/1992 Antosko
5,485,661 A 1/1996 McClure
5,487,240 A 1/1996 Miller
5,487,345 A * 1/1996 Winebarger et al. ..... 108/51.3
5,643,656 A 7/1997 Lin
5,658,644 A 8/1997 Ho et al.
5,728,478 A * 3/1998 Wilson et al. ..... 428/542.8
6,269,768 B1 8/2001 Zartman
6,338,172 B1 1/2002 Taylor et al.
6,874,972 B2 4/2005 Davis et al.
6,981,347 B1 1/2006 Walburger
7,003,822 B1 2/2006 Sheehy
7,017,205 B2 * 3/2006 Gladney ..... 5/400

(Continued)

*Primary Examiner* — Michael Trettel
*Assistant Examiner* — Richard G Davis
(74) *Attorney, Agent, or Firm* — Senniger Powers, LLP

(57) ABSTRACT

A lightweight bed assembly kit includes slats and runners adapted for connection to each other at spaced apart locations to form a grid. A U-shaped channel member is adapted for connection to the grid to form a support frame. A covering constructed to form a substantially smooth sleeping surface for an adult human is sized and shaped to be disposed on a top surface of the support frame. A method of assembling a lightweight bed includes arranging runners and slats transversely to each other and connecting the runners and slats together to form a grid. A U-shaped channel member is connected to the grid to form a support frame. A covering constructed to form a substantially smooth sleeping surface is mounted on a top surface of the support frame. A second support frame can be connected to the first support frame by another U-shaped channel member.

21 Claims, 14 Drawing Sheets

(56) References Cited

U.S. PATENT DOCUMENTS

| | | | | |
|---|---|---|---|---|
| 7,114,205 | B2 | 10/2006 | Choi | |
| 7,699,324 | B2 | 4/2010 | Walkingshaw et al. | |
| 8,127,929 | B1 * | 3/2012 | Lu et al. | 206/600 |
| 2005/0235417 | A1 * | 10/2005 | Koughan et al. | 5/400 |
| 2005/0247240 | A1 * | 11/2005 | Nelson | 108/51.3 |
| 2005/0278860 | A1 * | 12/2005 | Landi et al. | 5/690 |
| 2006/0107456 | A1 * | 5/2006 | Joseph | 5/2.1 |
| 2006/0123542 | A1 * | 6/2006 | Wilson et al. | 5/400 |
| 2007/0151026 | A1 * | 7/2007 | Felix | 5/201 |
| 2009/0307838 | A1 | 12/2009 | Claffy et al. | |
| 2011/0203050 | A1 * | 8/2011 | Rogers et al. | 5/285 |
| 2012/0204767 | A1 * | 8/2012 | Jian et al. | 108/51.3 |

* cited by examiner

PORTABLE LIGHTWEIGHT BED

FIELD OF THE INVENTION

The present invention generally relates to beds, and more specifically, temporary beds which are easily assembled and lightweight.

BACKGROUND OF THE INVENTION

Temporary beds are useful in certain situations where use of conventional beds may be cost- or space-prohibitive. For example, it may be necessary to temporarily provide sleeping quarters for large numbers of people with little advance warning. Conventional beds are relatively expensive and cannot be easily stored or transported to the location where needed Conventional mattresses and frames would require hiring moving crews to ship and set up where needed. The size of the mattresses and frames would necessitate having a large area for storage and also a very substantial transportation fleet should it be necessary to take the beds to another location for use. Even if a workforce were available to transport conventional beds to a remote location, the time necessary to perform this task would be considerable, leaving suddenly homeless persons with nothing to sleep on.

SUMMARY OF THE INVENTION

In one aspect of the present invention, a lightweight bed assembly kit generally comprises a plurality of slats and a plurality of runners. The slats and runners are adapted for connection to each other at spaced apart locations to form a grid. At least one U-shaped channel member is adapted for connection to the grid to form a support frame. A covering constructed to form a substantially smooth sleeping surface for a human is sized and shaped to be disposed on a top surface of the support frame.

In another aspect, a lightweight bed assembly kit generally includes a plurality of slats and a plurality of runners. The slats and runners are adapted for connection to each other at spaced apart locations to form a grid. A sheet of corrugated material is disposed on an upper surface of the grid as a planar covering. The planar covering is constructed to form a substantially smooth sleeping surface for an adult human. Surface channels are located on the substantially smooth sleeping surface to allow air circulation between the adult human and the sleeping surface.

In yet another aspect, a method of assembling a lightweight bed generally comprises arranging a plurality of runners and a plurality of slats generally transversely to each other and connecting the runners and slats together to form a grid including spaced apart slats and runners. At least one U-shaped channel member is connected to the grid to form a support frame. A covering constructed to form a substantially smooth sleeping surface is mounted on a top surface of the support frame.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
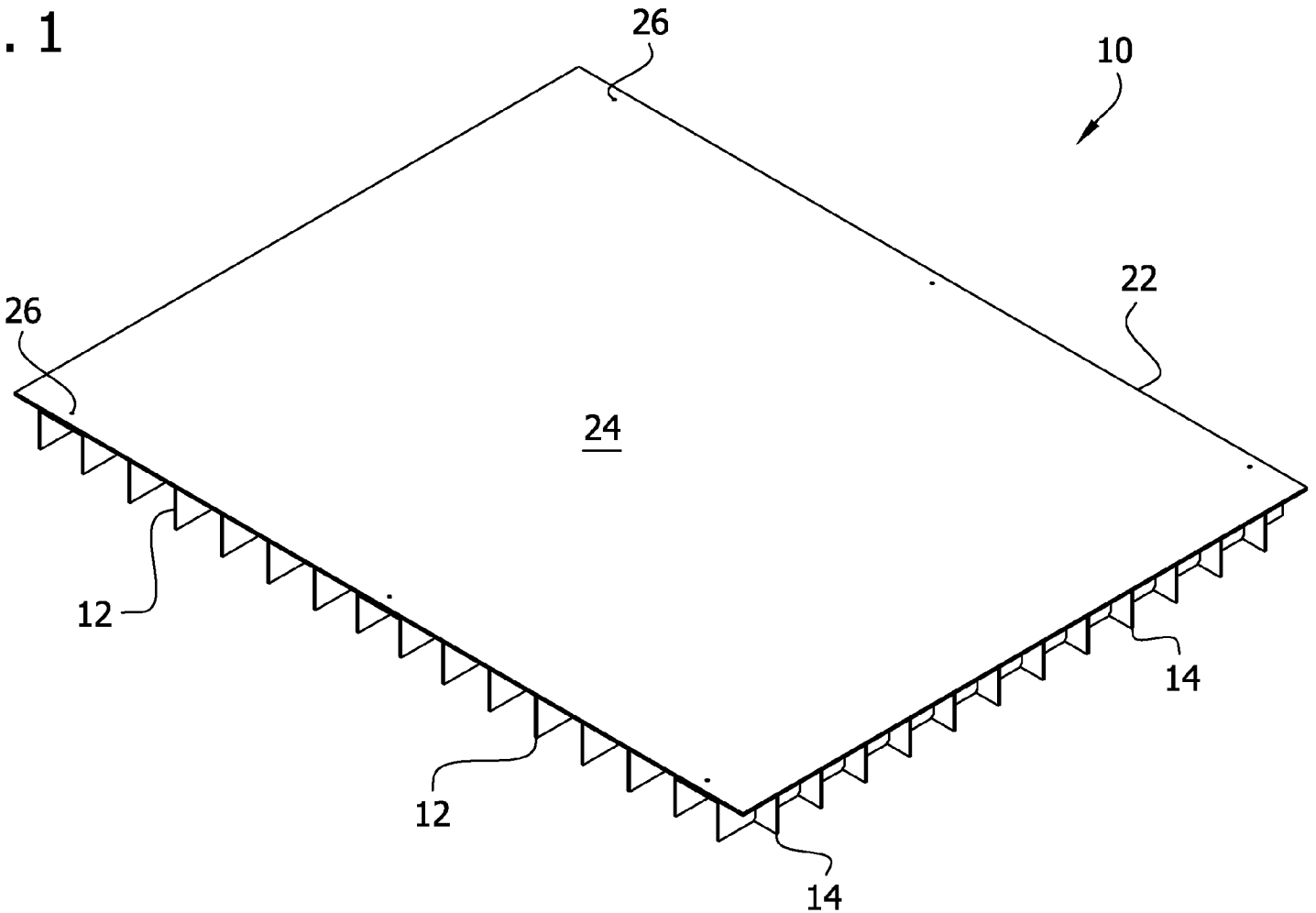
FIG. 1 is a perspective view of a lightweight bed assembly according to the present invention.
Figure 2:
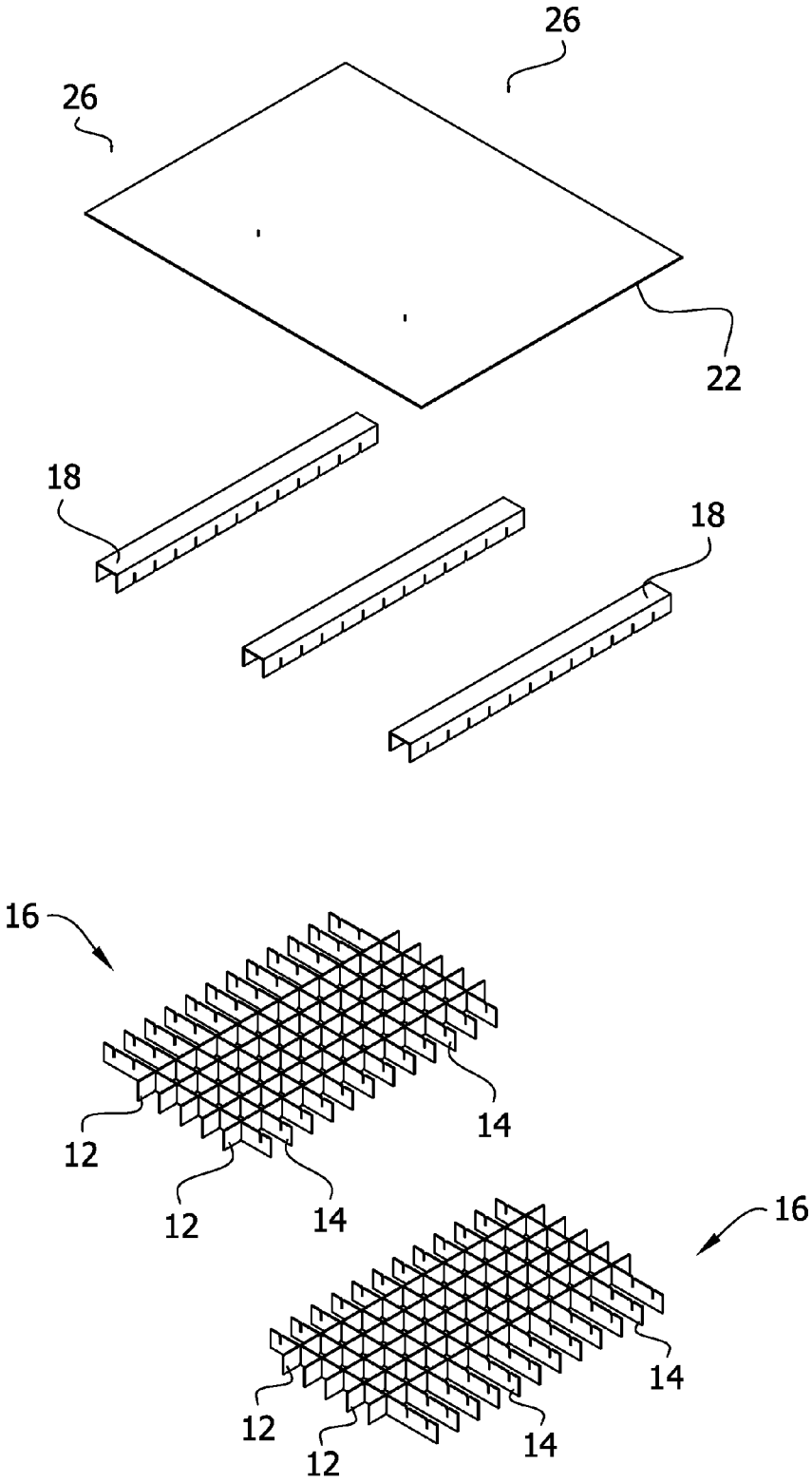
FIG. 2 is an exploded view of the lightweight bed assembly.
Figure 7:
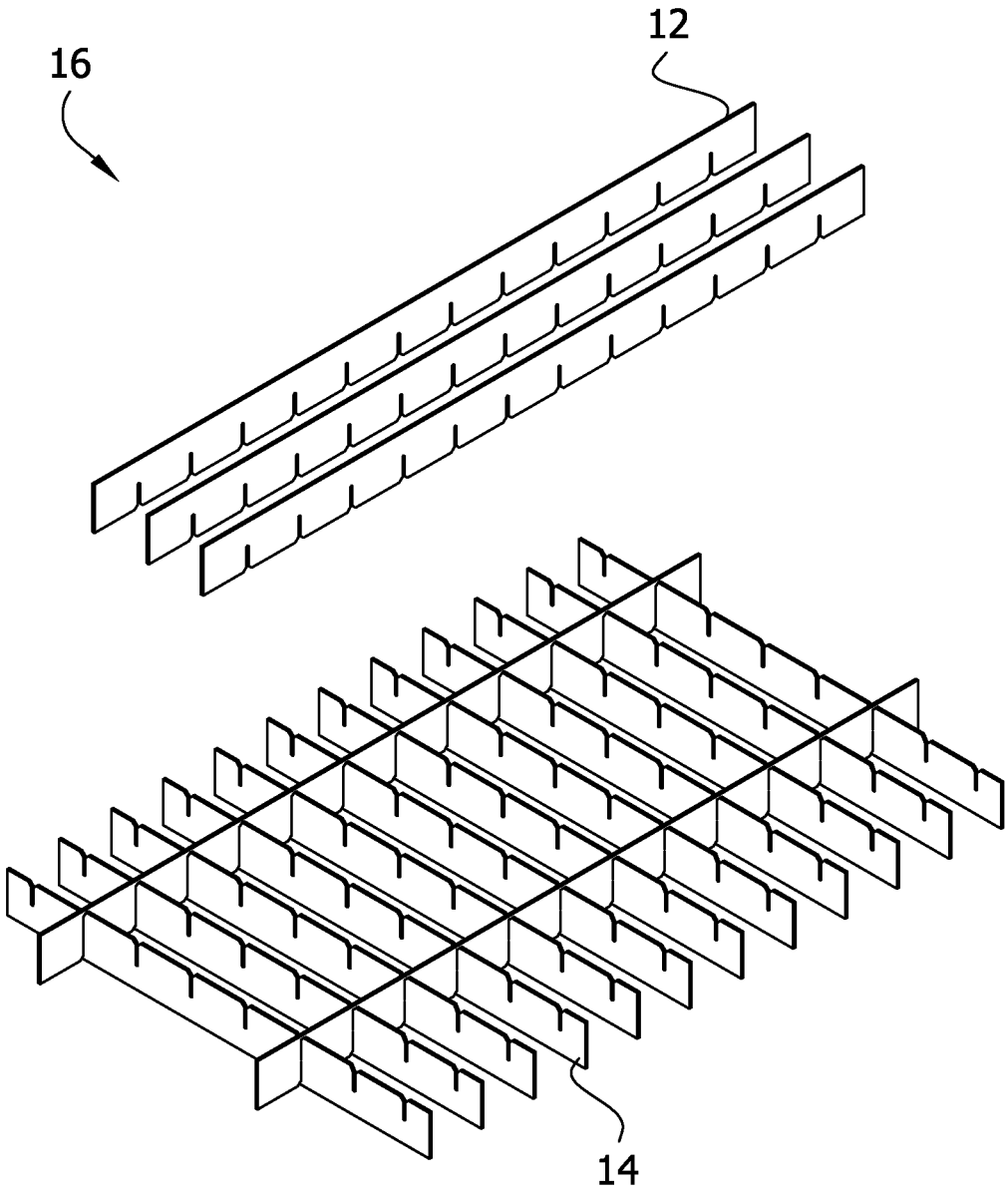
FIG. 7 is a perspective view of a partially constructed grid of runners and slats.
Figure 8:
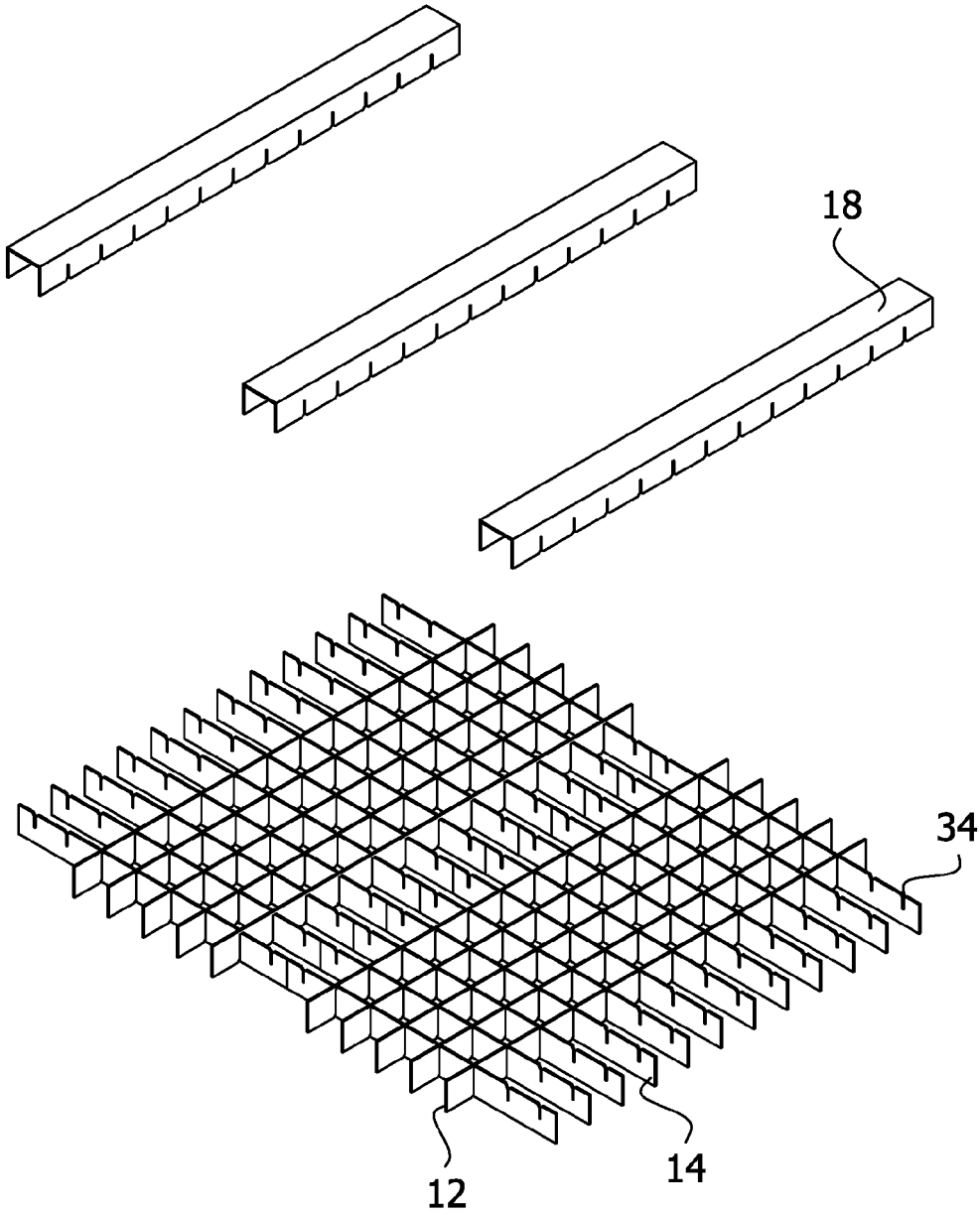
FIG. 8 is an perspective of two grids aligned for connection as a bed assembly.

Referring to FIGS. 1, 2, and 7, a lightweight bed assembly generally indicated at 10 is easily assembled for use as a temporary bed. The lightweight bed assembly 10 can be used in shelters, disaster relief centers, or in any location or situation where easily assembled beds may be useful. The lightweight bed assembly 10 includes a plurality of runners 12 and slats 14 which are connected to form a grid 16, at least one channel member 18 connected to the grid 16 to form a support frame 20, and a covering 22 disposed on the frame 20 to form a sleeping surface 24 (see generally FIGS. 1 and 2). Screws 26 secure the covering 22 to the support frame 20.

Figure 3:
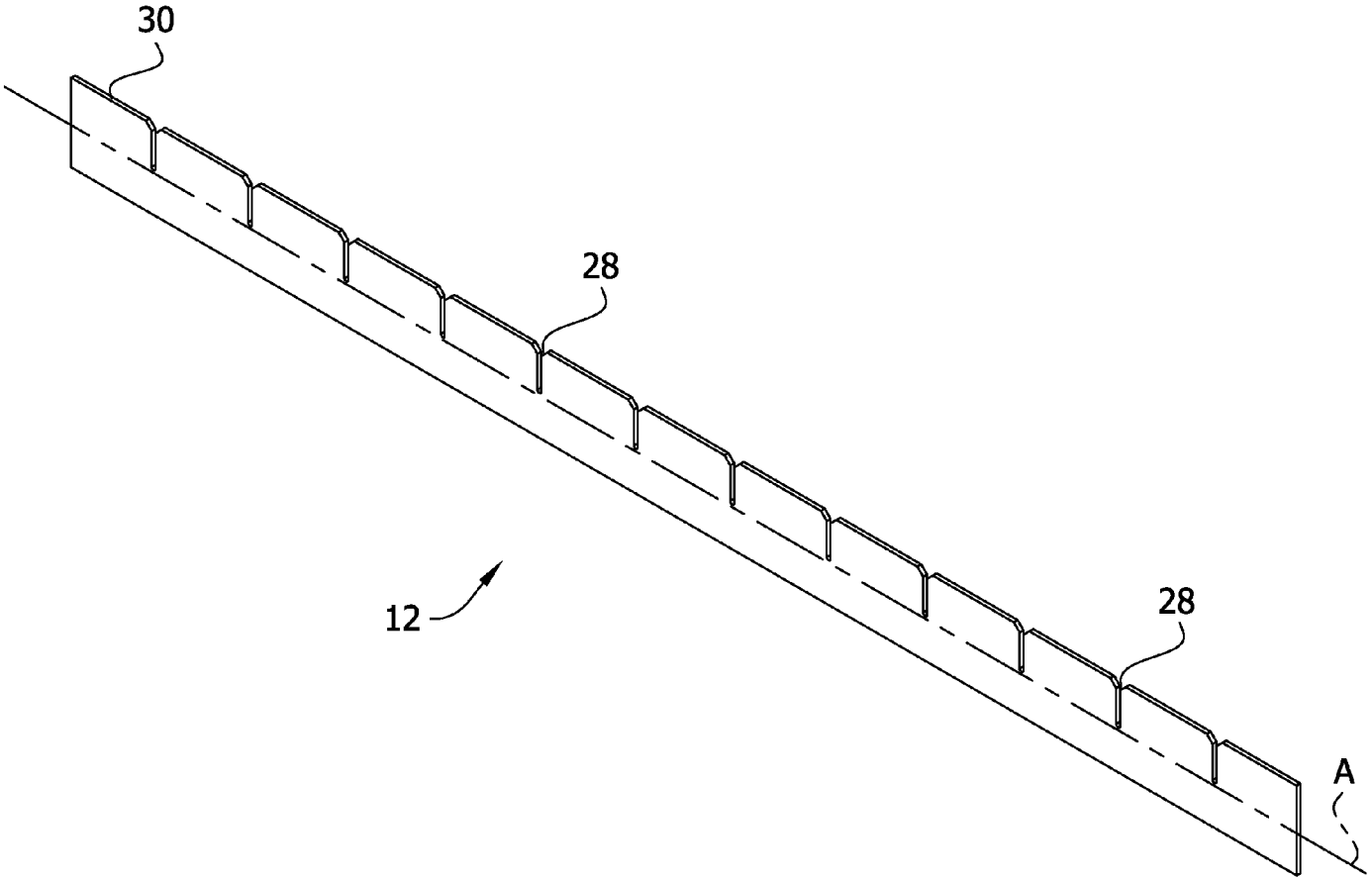
FIG. 3 is a perspective view of a runner used in the lightweight bed assembly.
Figure 4:
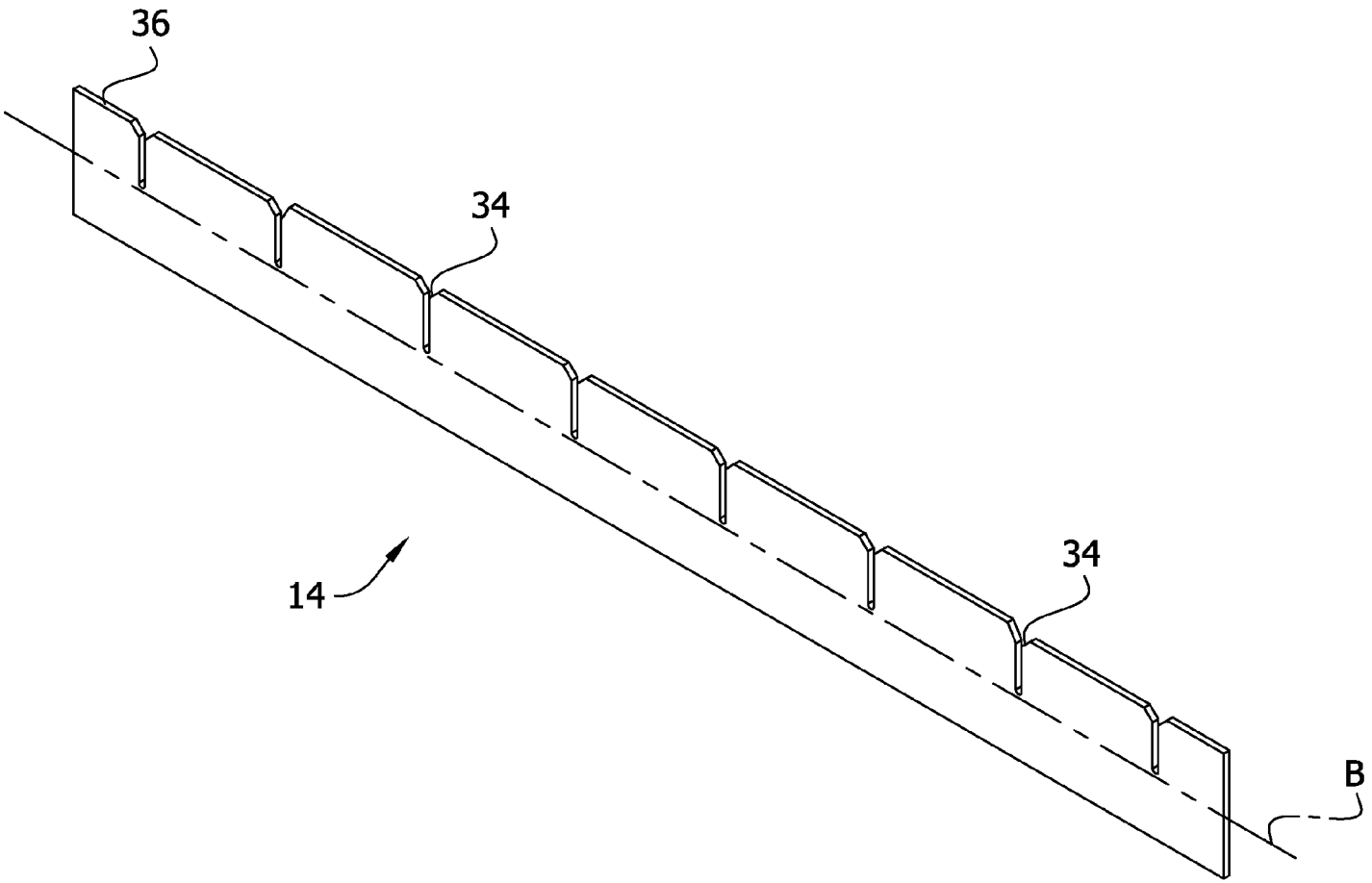
FIG. 4 is a perspective view of a slat used in the lightweight bed assembly.

In the illustrated embodiment, runners 12 are generally planar, and include slots 28 extending from a first side 30 of the runner toward a longitudinal axis A of the runner (see FIG. 3). As shown in FIG. 4, slats 14 are generally planar and include slots 34 extending from a first side 36 of the slat toward a longitudinal axis B of the slat. The runners 12 and slats 14 are adapted for connection to each other at spaced apart locations to form a grid 16 (see FIG. 7). In the illustrated embodiment, the runners 12 and slats 14 connect to each other by engaging slots 28 of the runners with slots 34 of the slats. Other configurations of runners and slats to form a grid are within the scope of the present invention.

Referring to FIGS. 3 and 4, respectively, runners 12 and slats 14 can be made in any size, depending on the desired size of the lightweight bed assembly. In one embodiment, runners 12 are approximately 79 inches long, approximately 5 inches wide, and approximately 0.25 inches thick. As illustrated in FIG. 3, runners 12 include twelve slots 28 at spaced intervals along the longitudinal axis A of the runners. The slots 28 are spaced about 6 inches from each other, though the spacing can vary along the length of the runner 12. Slats 14 are approximately 50.5 inches long, approximately 5 inches wide, and approximately 0.25 inches thick. As illustrated in FIG. 4, slats 14 include eight slots 34 at spaced intervals along the longitudinal axis B of the slats. The slots 34 are spaced about 6.5 inches from each other, though the spacing can vary along the length of the slat 14. Other sizes and configurations are possible within the scope of the present invention.

Figure 5:
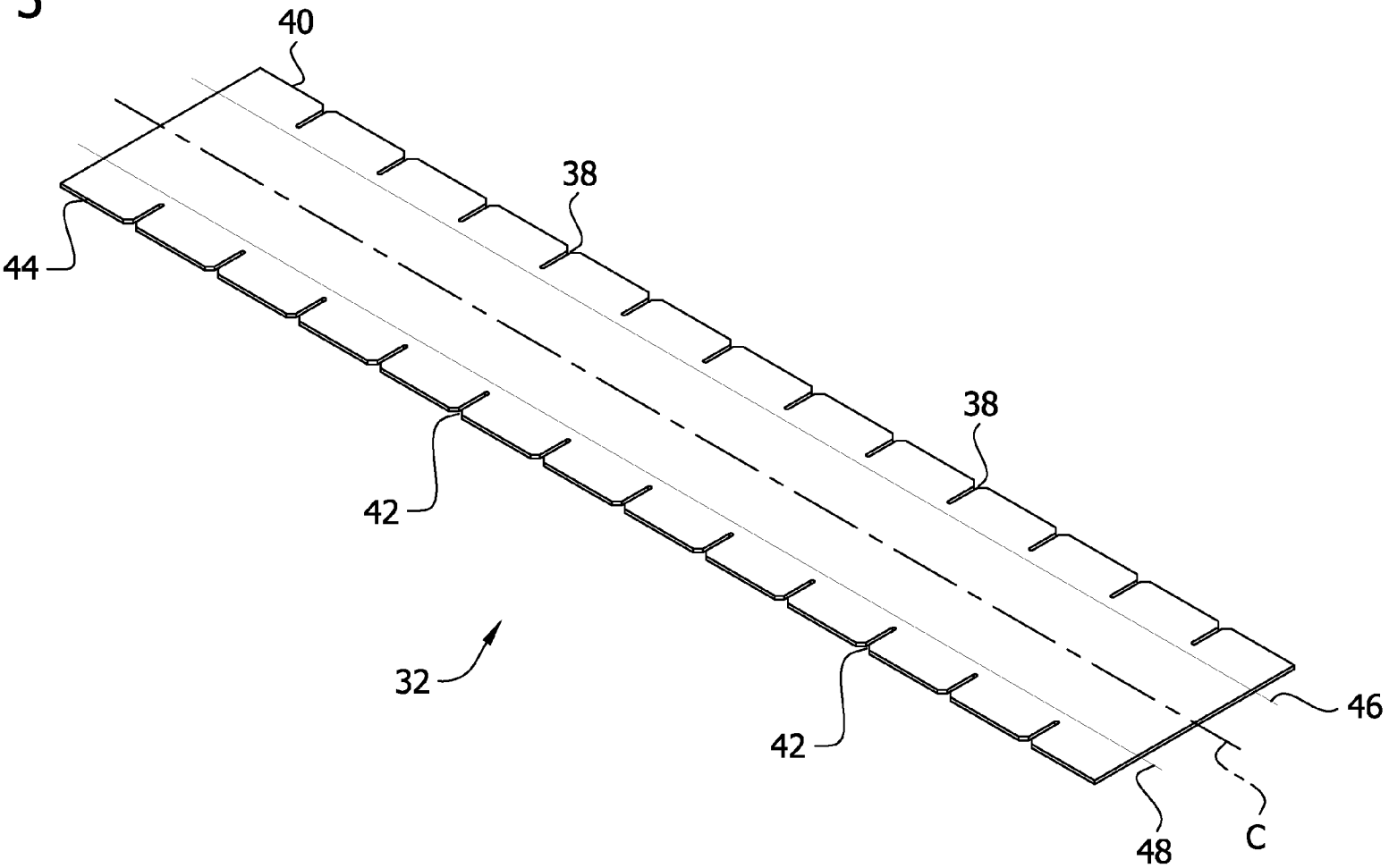
FIG. 5 is a perspective view of a channel member used in the lightweight bed assembly.
Figure 6:
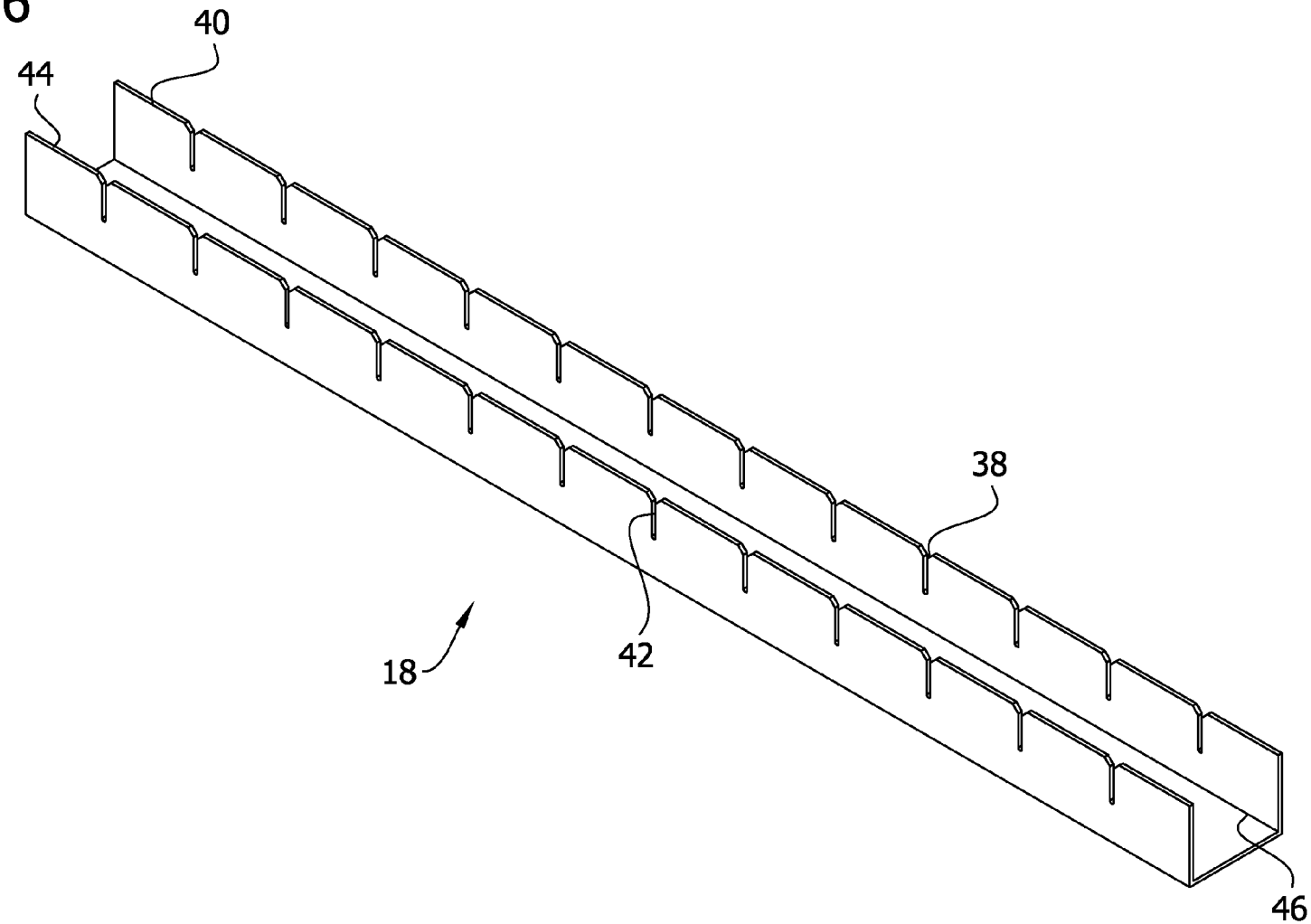
FIG. 6 is a perspective view of the channel member folded into a U-shape for use in the lightweight bed assembly.

In the illustrated embodiment, channel members 18 are adapted for connection to the grid 16 to form the support frame 20. As shown in FIGS. 5 and 6, each channel member 18 can be formed as a flat blank 32 that is folded into shape. The blank 32 includes slots 38 extending from a first side 40 of the blank toward a longitudinal axis C of the blank. The blank 32 further includes slots 42 extending from a second side 44 of the blank toward the longitudinal axis C. As illustrated, slots 38, 42 are preferably aligned, such that for every slot 38 extending from the first side 40 there is a corresponding slot 42 extending from the second side 44 of the blank 32. In one embodiment, channel members 18 are each approximately 79 inches long, approximately 15.5 inches wide, and approximately 0.25 inches thick. As illustrated, each channel member 18 includes twelve slots 38 and twelve slots 42 at spaced intervals along the longitudinal axis C of the channel member. The slots 38 are spaced about 6 inches from each other, though the spacing can vary along the length of the channel member 18. Preferably, the slots 42 are also spaced about 6 inches from each other, though the spacing can vary along the length of the channel member 18. The blank 32 can include a first score line 46 extending parallel to the longitudinal axis C along the length of the channel member. The blank 32 can further include a second score line 48 extending parallel to the longitudinal axis C along the length of the channel member, the first and second score lines 46, 48 being on opposite sides of the longitudinal axis C. It will be understood that the size and configuration of the blank 32 may be other than described hereinabove within the scope of the present invention. When used in the lightweight bed assembly, the blank 32 can be folded along the score lines 46, 48 into a U-shape, forming the channel member 18, as shown in FIG. 6.

To assemble a lightweight bed assembly 10 according to the present invention, the runners 12 and slats 14 are arranged generally transversely to each other and connected to form the grid 16. At least one channel member 18 is connected to the grid 16 to form the support frame 20. A covering 22 is mounted on a top surface of the support frame 20 to form a substantially smooth sleeping surface 24. For ease of assembly and disassembly, the covering 22 can preferably be folded or rolled. The covering 22 can be secured to the support frame 20 by screws 26 that extend through the covering 22 and into a broad, flat floor of the channel member 18. In one embodiment, a second support frame 120, substantially identical to the support frame 20 described above, is connected to the first support frame 20. The covering 22 is preferably sized and shaped to cover both support frame 20 and support frame 120 to form the substantially smooth sleeping surface 24.

More specifically in the illustrated embodiment, five runners 12 are connected to twelve slats 14 by engaging the slots 28 of the runners with the slots 34 of the slats. The runners 12 and slats 14 are arranged transversely to each other, and the slots 28, 34 are engaged to form a grid 16 of spaced apart runners and slats. The runners 12 and slats 14 are connected such that each slat 14 has at least one slot 34 remaining open and unengaged. Preferably, each slat 14 has at least two slots 34 remaining open and unengaged, and more preferably, each slat has three slots 34 remaining open and unengaged (see FIG. 7). Two of these slots 34 lie next to each other at an end of the slat 14 opposite and end where the third open slot is located. A channel member 18 which has been folded along score lines 46, 48 to form a U-shaped channel member is connected to the grid 16 by engaging slots 38, 42 with respective adjacent open slots 34 of all the slats 14, thereby forming a support frame 20. Preferably, a second support frame 120 also includes five runners 12 connected to twelve slats 14 by engaging the slots 28 of the runners with slots 34 of the slats to form another grid 16, and a U-shaped channel member 18 connected to the grid by engaging its slots 38, 42 with open slots 34 of the slats. Second support frame 120 is substantially identical to support frame 20. It is to be understood that the second support frame 120 may differ in configuration from the support frame 20 within the scope of the present invention.

The second support frame 120 is aligned with the first support frame 20 so that the remaining open slot 34 of each slat 14 of the first support frame 20 is aligned with the remaining open slot 34 of each slat 14 of the second support frame 120. Another U-shaped channel member 18 is used to connect support frame 20 to support frame 120 by inserting the slots 38 of the U-shaped channel member into the open slots 34 of the first support frame 20, and the slots 42 of the U-shaped channel member into the open slots 34 of the second support frame 120. Any number of support frames can be connected together in this manner by U-shaped channel members, thereby allowing for a bed of any size to be constructed.

Figure 10:
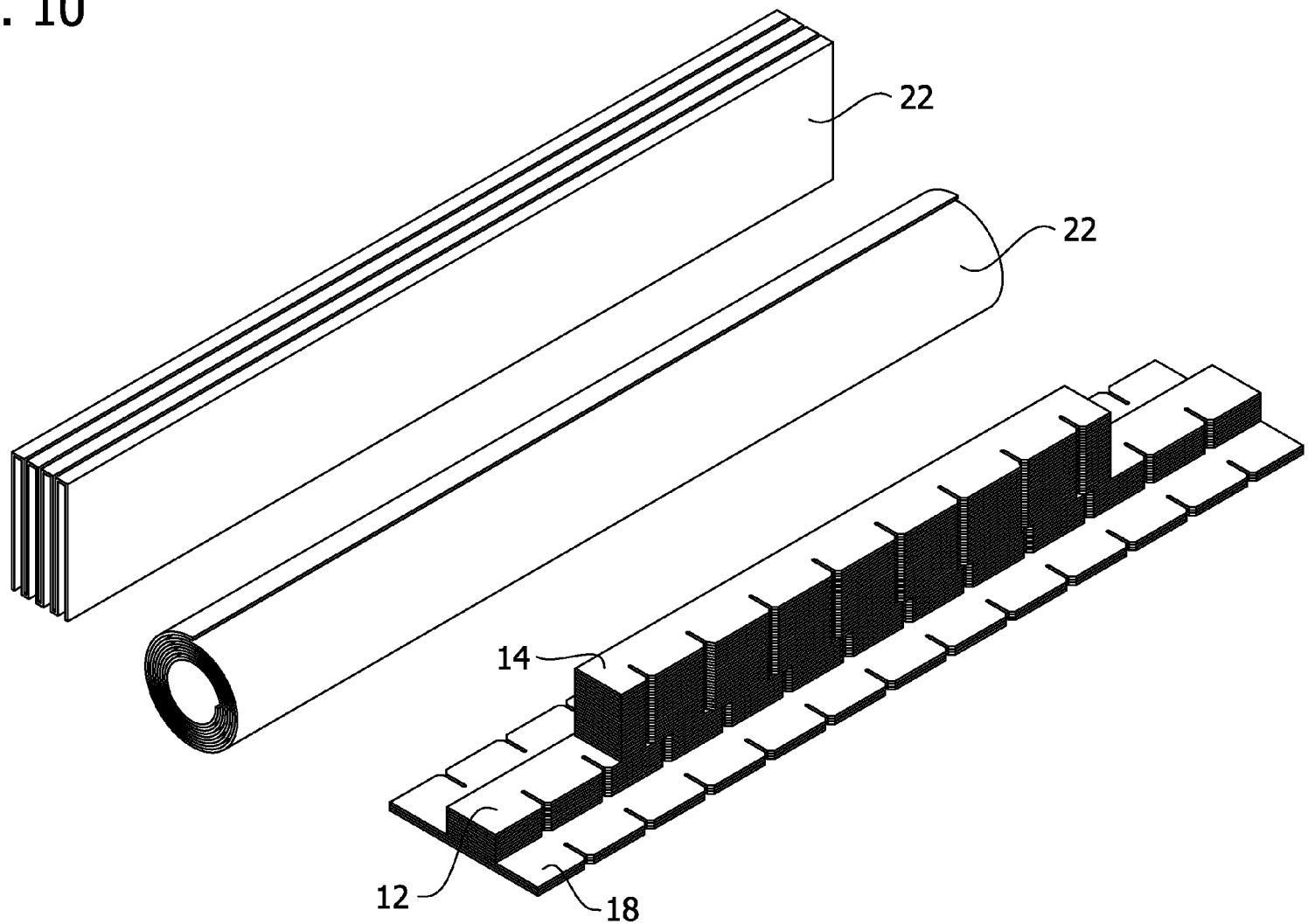
FIG. 10 is a perspective view of the components of a lightweight bed assembly stacked for storage, and illustrates a folded covering and a rolled covering.

In the illustrated embodiment, a total of ten runners 12, twenty-four slats 14, three U-shaped channel members 18, one covering 22, and six screws 26 are used to form the lightweight bed assembly 10. Preferably, the bed assembly 10 is lightweight, so it is easy to assemble and disassemble, and is also easy to transport. Preferably, the bed assembly 10 weighs no more than about 50 pounds, and more preferably weighs no more than about 35 pounds. The bed assembly 10 is also easy to transport because it can be broken down to its component parts, which can be stacked for transport (see FIG. 10). FIG. 10 shows the components of an embodiment of the lightweight bed assembly stacked for storage or transport, and illustrates two options for storing or transporting covering 22. Covering 22 preferably can be folded or rolled for ease of storage and transport. Alternatively, once covering 22 and channel members 18 are removed from the grid 16, the grid can be collapsed without requiring disassembly of the runners 12 and slats 14. Grid 16 can be collapsed pivoting the runners relative to the slats where they are connected together (i.e., "parallelogram") into a substantially flat stack of runners 12 and slats 14, without requiring that the runners and slats be disconnected from each other. Thus, the bed assembly 10 can be easily stored or transported, and it is quick to set up when necessary because the grid 16 is already formed.

The lightweight bed assembly 10 described above can be made of any material, and preferably is made of plastic corrugated board. Preferably, each component of the lightweight bed assembly 10 is made of the same material, but a lightweight bed assembly constructed of components made from different materials is within the scope of the present invention. More preferably, each component of the lightweight bed assembly 10 is made of plastic corrugated board as described and disclosed in U.S. Pat. No. 5,658,644, the entirety of which is incorporated herein by reference.

Figure 11:
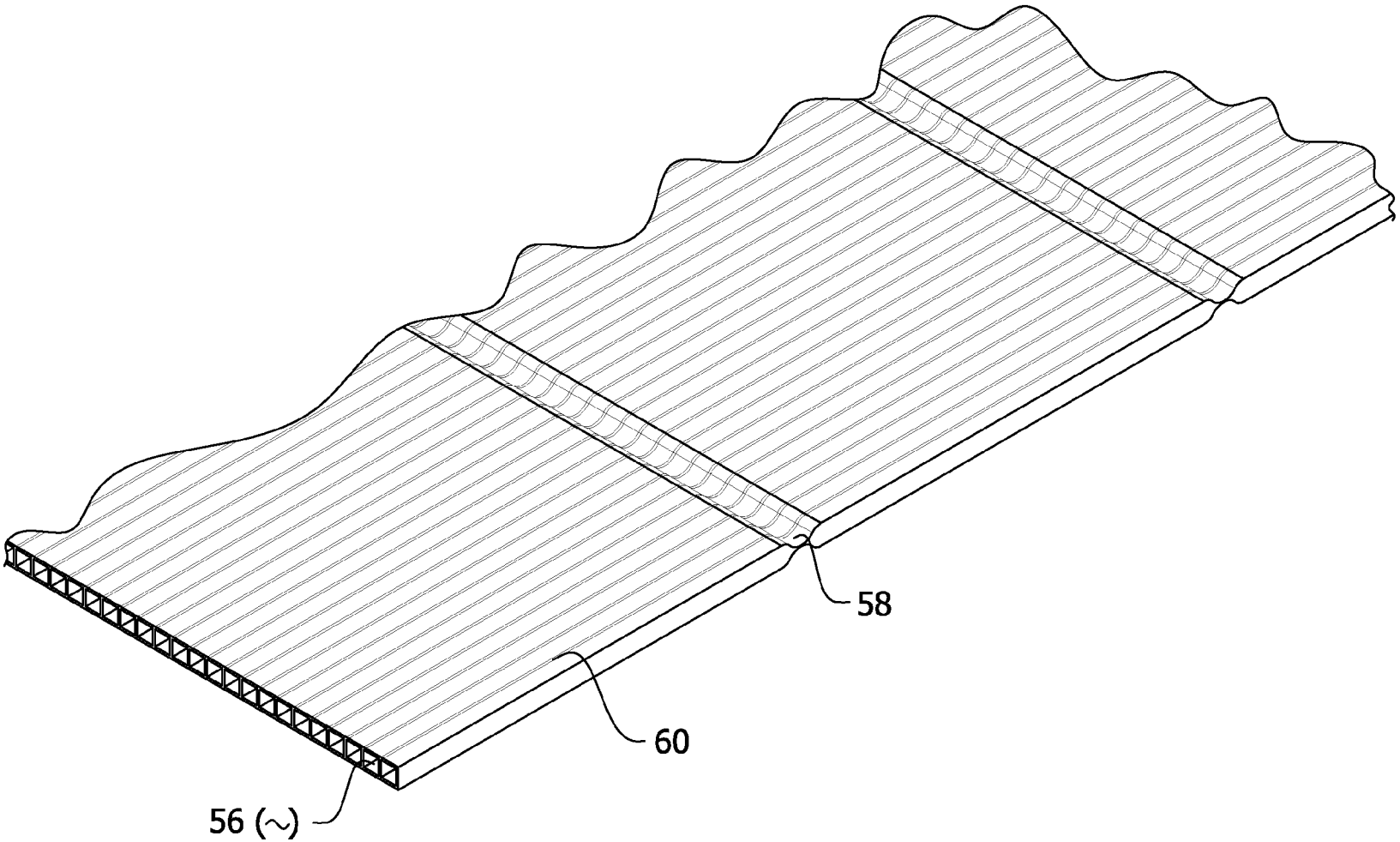
FIG. 11 is a perspective view of a material that can be used to make the lightweight bed assembly, plastic corrugated board with surface channels.
Figure 12:
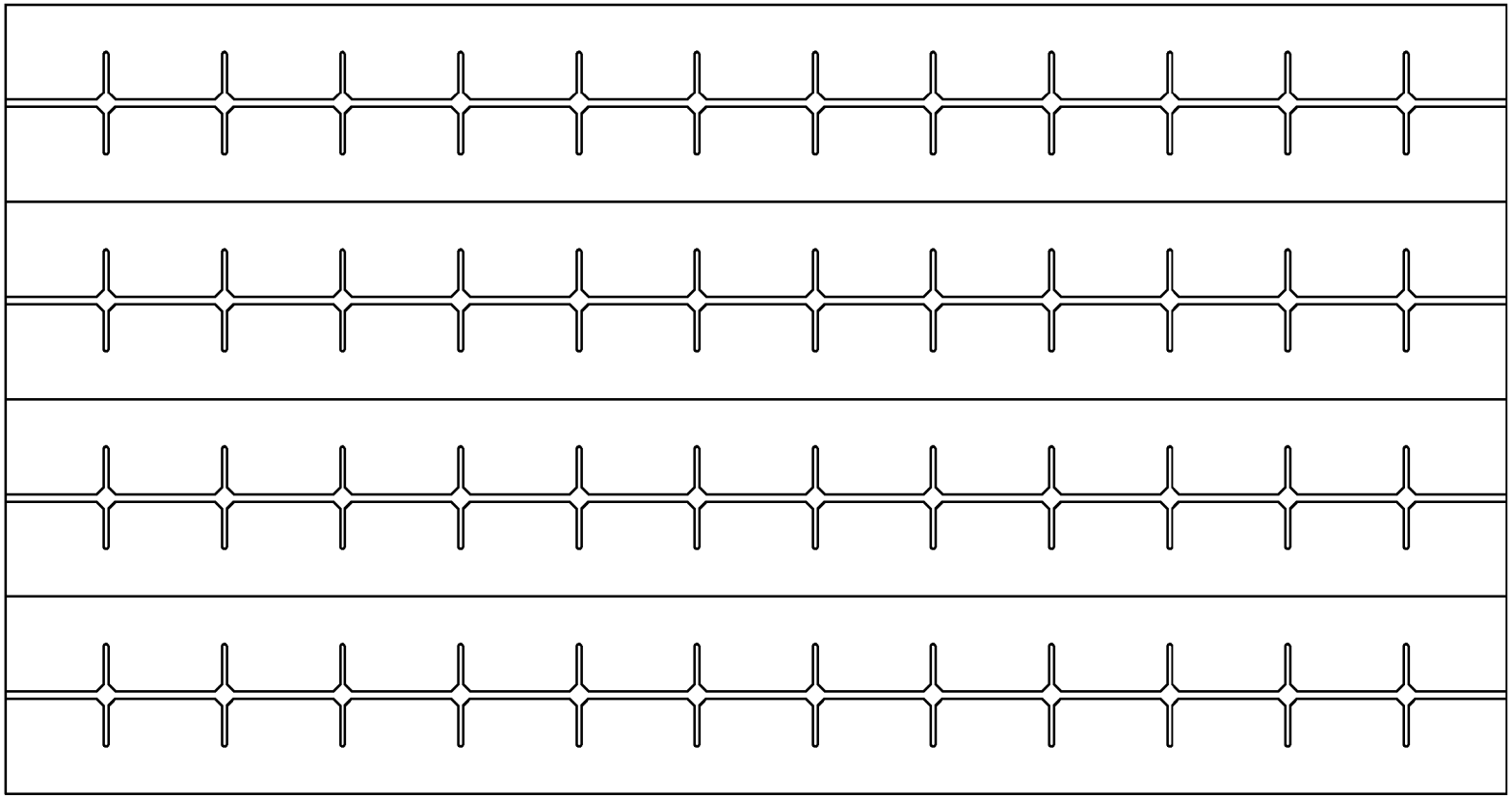
FIG. 12 is a schematic of a die layout for producing the runners of the lightweight bed assembly.
Figure 13:
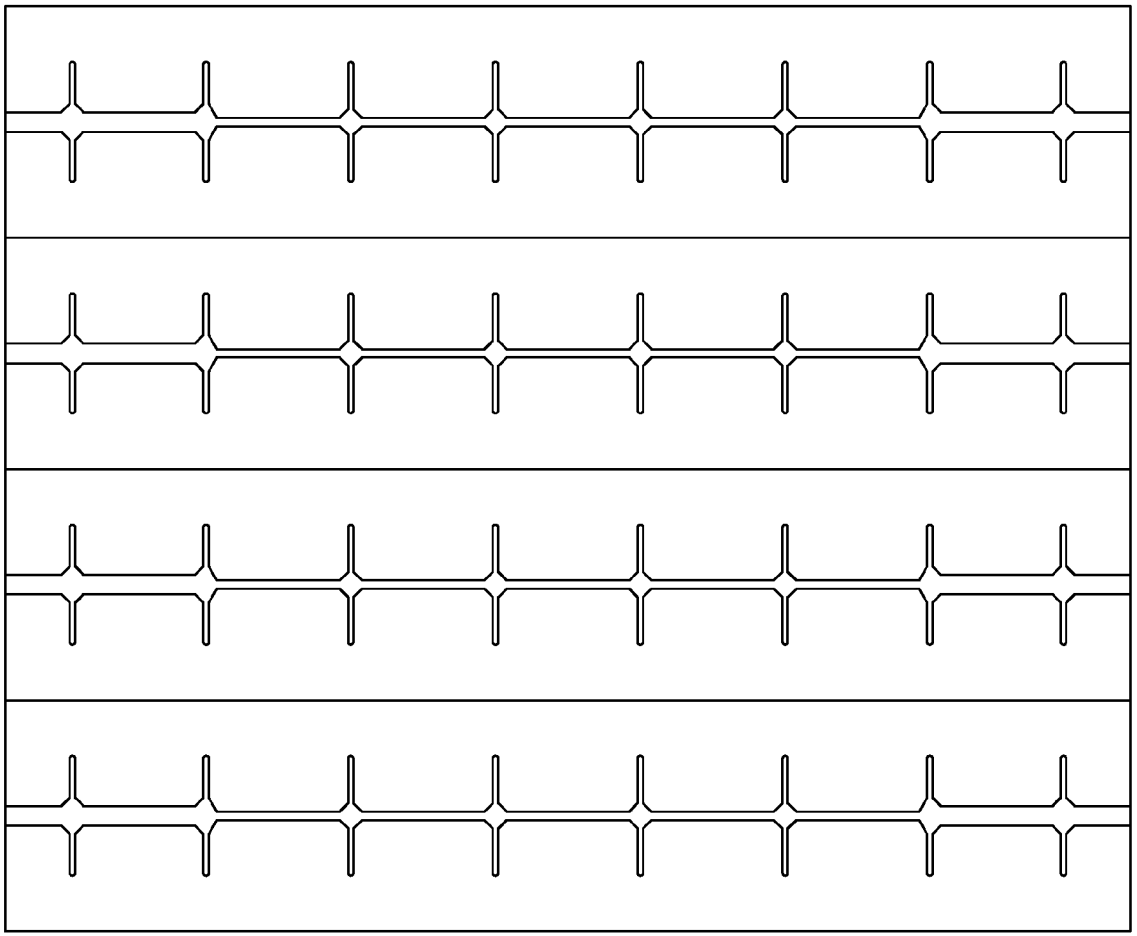
FIG. 13 is a schematic of a die layout for producing the slats of the lightweight bed assembly.
Figure 14:
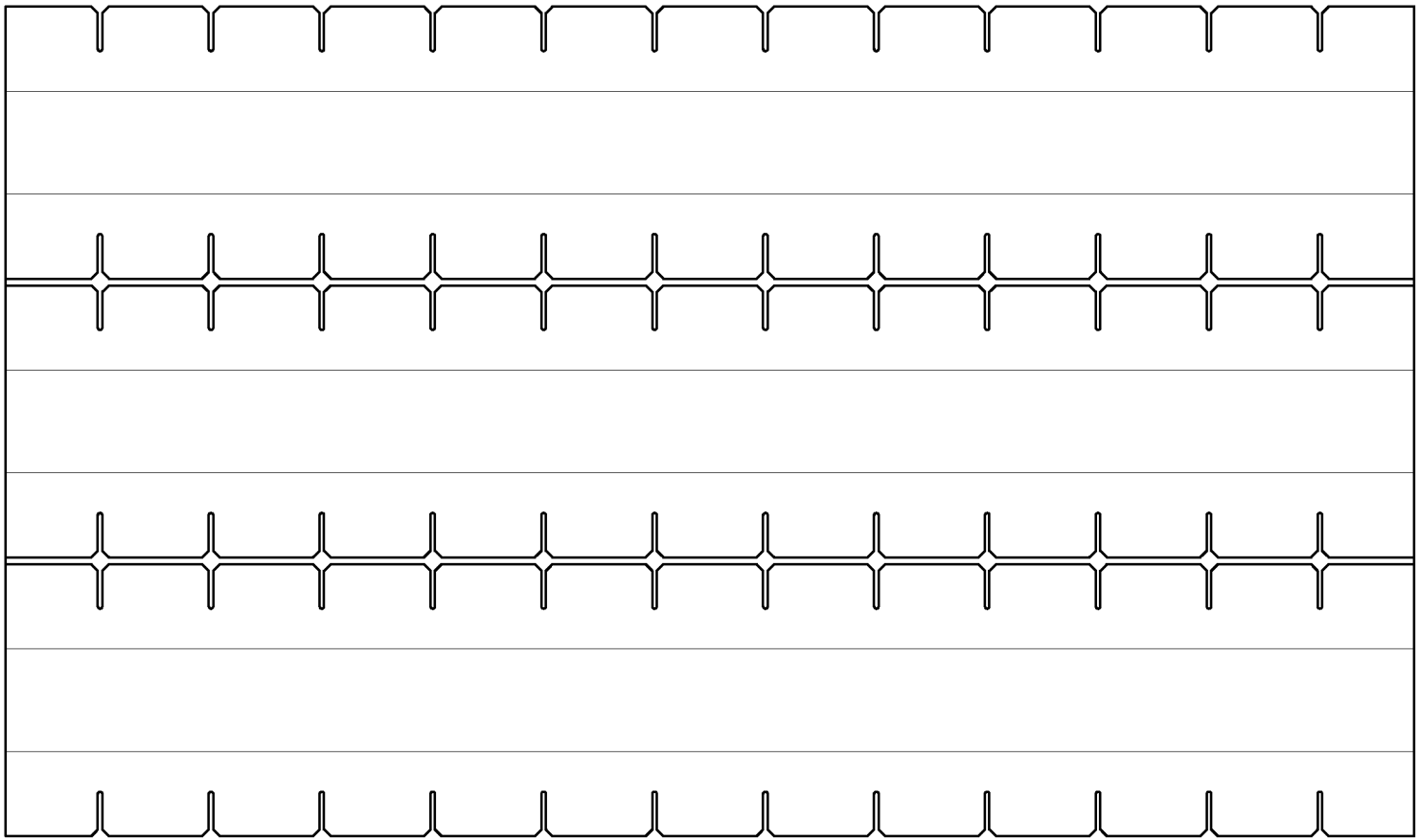
FIG. 14 is a schematic of a die layout for producing the channel members of the lightweight bed assembly.

Covering 22 is preferably made of the plastic corrugated board disclosed in the '644 patent, because the material is suited to creating a superior sleeping surface 24. In the preferred embodiment, covering 22 is a planar sheet of corrugated material. More preferably, covering 22 is made of the plastic corrugated board as disclosed in the '644 patent that has been passed through a heat scoring process in which the flutes of the plastic board are heat-sealed at spaced intervals by a press roller, as shown in FIG. 11. The plastic corrugated board has sealed air pockets 56 that provide cushioning for a person using the sleeping surface 24 (see FIG. 11). The air pockets are formed by the corrugations of the plastic corrugated board and by the heat sealing of the flutes. The heat sealing process also forms spaced indentations in the plastic corrugated board, thereby forming surface channels 58 on the covering 22. Since plastic material is impermeable to water vapor, sleeping on a plastic surface could cause discomfort to a person because the surface water of the body, such as sweat, cannot evaporate. However, a covering 22 according to the present invention preferably has surface channels 58 that improve air circulation between the body of the user and the sleeping surface 24, thereby increasing the comfort of a user. Surface channels 58 extend in the cross-flute direction of the corrugation of the plastic corrugated board, i.e. in a direction transverse to the direction of corrugation. Covering 22 can also be extruded to form channels 60 in the flute direction of the corrugation of the plastic corrugated board, to further improve air circulation. In the preferred embodiment, channels 60 have a smaller depth than surface channels 58 formed by the heat sealing process. The surface channels 58 and the channels 60 are sufficiently small to be substantially imperceptible to the user lying on the sleeping surface 24. Thus, the covering 22 forms a substantially smooth sleeping surface notwithstanding the channels.

Figure 9:
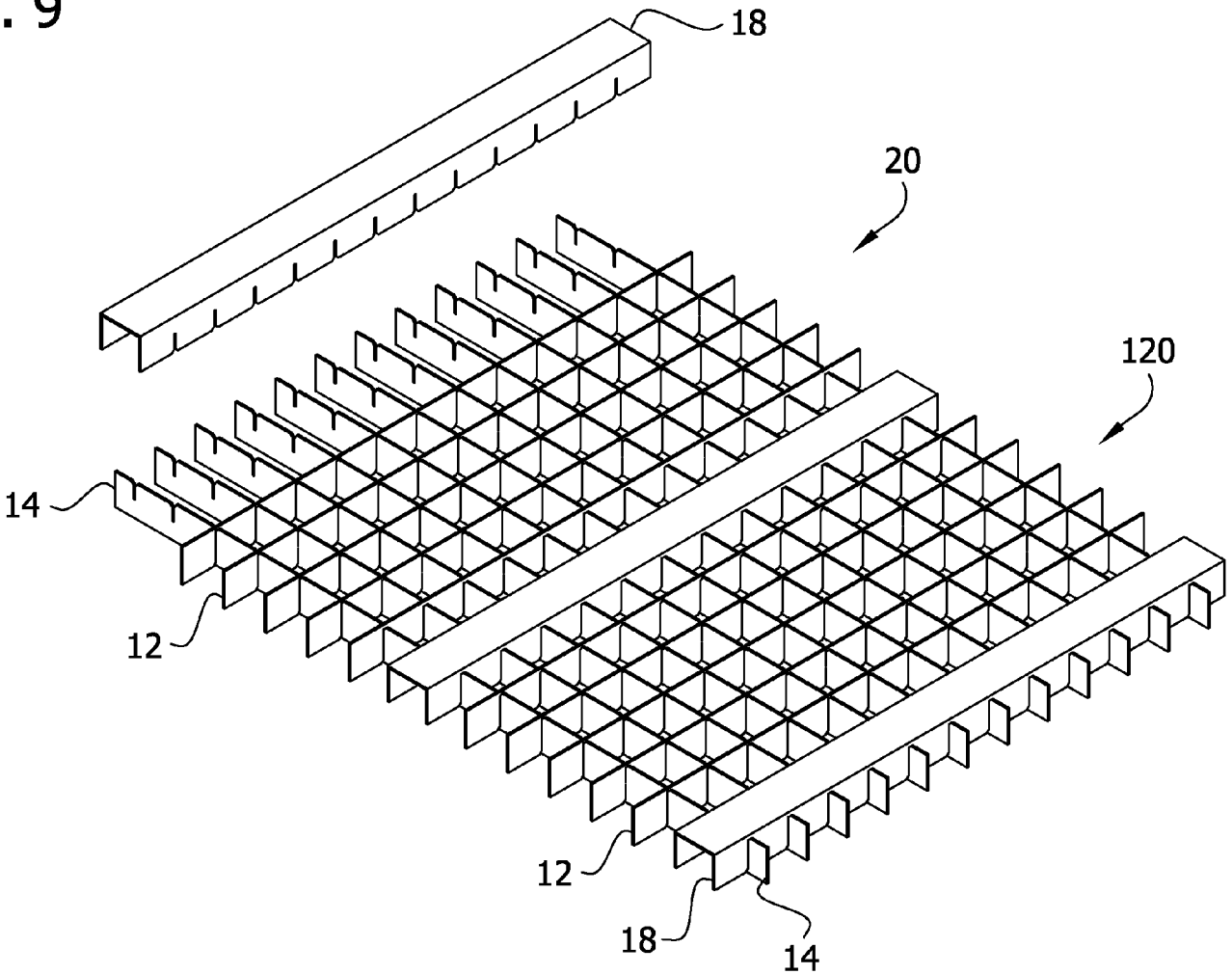
FIG. 9 is a perspective view of two support frames connected together to form a lightweight bed assembly

Another advantage to using plastic corrugated board is that the components of the lightweight bed assembly can be shaped using die layouts, as is known in the art. FIGS. 9-11 show examples of die layouts that can be used to make the runners, slats, and channel members of the preferred embodiment described above. Additionally, plastic corrugated board according to the '644 patent has superior flat crush resistant properties, which makes the material ideal for supporting many human adults on the lightweight bed assembly.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products and methods without departing from the scope of the invention, it is intended that all matter contained in the above description and shown in the accompanying drawings shall be interpreted as illustrative and not in a limiting sense.

What is claimed is:

1. A lightweight bed assembly kit comprising: a plurality of slats;

a plurality of runners, the slats and runners being adapted for connection to each other at spaced apart locations to form a grid;

at least one U-shaped channel member adapted for receiving a portion of the grid and connecting to the grid to form a support frame; and a covering distinct from said U-shaped channel member and sized and shaped to be disposed on a top surface of the support frame and constructed to form a substantially smooth sleeping surface for a human.

2. The lightweight bed assembly kit of claim 1, wherein the slats, the runners, the channel member, and the covering are all made of the same material.

3. The lightweight bed assembly kit of claim 2, wherein the slats, the runners, the channel member, and the covering are made of plastic corrugated board.

4. The lightweight bed assembly kit of claim 1, wherein the kit further comprises a second support frame, the second support frame comprising a plurality of slats, a plurality of runners, the slats and runners being adapted for connection to each other at spaced apart locations to form a grid, and at least one U-shaped channel member adapted for connection to the grid.

5. The lightweight bed assembly kit of claim 4, wherein the assembly kit weighs no more than about 35 pounds.

6. The lightweight bed assembly kit of claim 4, wherein the at least one U-shaped channel member is adapted to connect the support frame to the second support frame.

7. The lightweight bed assembly kit of claim 4, wherein the covering is a unitary covering sized and shaped to simultaneously cover both the support frame and the second support frame.

8. The lightweight bed assembly kit of claim 1, wherein the covering is mounted on the support frame with at least one screw.

9. The lightweight bed assembly kit of claim 1, wherein the covering is a unitary covering made of plastic corrugated board that is heat sealed at spaced intervals.

10. The lightweight bed assembly kit of claim 1, wherein the covering comprises a plurality of surface channels adapted to improve air circulation over the substantially smooth sleeping surface.

11. The lightweight bed assembly kit of claim 1, wherein the covering is adapted to be folded for easy disassembly.

12. The lightweight bed assembly kit of claim 1, wherein the runners further comprise engaging slots at spaced intervals along a length of the runner.

13. The lightweight bed assembly kit of claim 12, wherein the slats further comprise engaging slots at spaced intervals along a length of the slat, the engaging slots of the slats being adapted to engage the engaging slots of the runners.

14. The lightweight bed assembly kit of claim 1, wherein the support frame comprises ten runners.

15. The lightweight bed assembly kit of claim 14, wherein the support frame further comprises twenty-four slats.

16. A lightweight bed assembly kit comprising: a plurality of slats;

a plurality of runners, the slats and runners being adapted for connection to each other at spaced apart locations to form a grid;

a sheet of corrugated material adapted to be disposed on an upper surface of the grid as a planar covering, the planar covering being constructed to form a substantially smooth sleeping surface; and surface channels located on the substantially smooth sleeping surface to allow air circulation over the sleeping surface, the surface channels including first channels extending in a first direction and second channels extending in a second direction transverse to the first direction.

17. The lightweight bed assembly kit of claim 16, wherein the surface channels located on the substantially smooth sleeping surface comprise:

heat-sealed channels having a depth and extending in a direction transverse to a direction of corrugation of the corrugated material; and extruded channels having a depth and extending in a direction parallel to the direction of corrugation of the corrugated material, wherein the depth of the extruded channels is less than the depth of the heat sealed channels.

18. The lightweight bed assembly kit of claim 16, wherein the planar covering is adapted to be one of rolled and folded for storage or transport.

19. A method of assembling a lightweight bed, the method comprising: arranging a plurality of runners and a plurality of slats generally transversely to each other and connecting the runners and slats together to form a grid including spaced apart slats and runners;

connecting at least one U-shaped channel member to the grid to form a support frame, said connecting comprises said at least one U-shaped channel member receiving a portion of the grid;

and mounting a covering separate from said U-shaped channel member on a top surface of the support frame, wherein the covering is constructed to form a substantially smooth sleeping surface.

20. The method of claim 19 further comprising connecting a second support frame to the support frame, wherein the second support frame comprises a plurality of runners and a plurality of slats arranged generally transversely to each other and connected together to form a grid including spaced apart slats and runners and at least one U-shaped channel member connected to the grid.

21. The method of claim 19 further comprising attaching the covering to the top surface of the support frame with at least one screw.

* * * * *